United States Patent [19]

Warne

[11] 4,441,980

[45] Apr. 10, 1984

[54] APPARATUS FOR DETERMINING UNDERWATER POTENTIAL DIFFERENCES EMPLOYING LUGGINS TUBULUS

[75] Inventor: Michael A. Warne, Brewood, England

[73] Assignee: Global Cathodic Protection Ltd., Shropshire, England

[21] Appl. No.: 374,727

[22] Filed: May 4, 1982

[30] Foreign Application Priority Data

May 9, 1981 [GB] United Kingdom ..... 8114232

[51] Int. Cl.[3] ..... G01N 27/30

[52] U.S. Cl. ..... 204/409; 204/435; 324/425

[58] Field of Search ..... 204/195 C, 195 F, 195 R, 204/1 C; 324/51, 425

[56] References Cited

U.S. PATENT DOCUMENTS

| | | | |
|---|---|---|---|
| 2,910,420 | 10/1959 | Preiser | 204/195 F |
| 3,192,144 | 6/1965 | Heuze | 204/195 F |
| 4,056,446 | 11/1977 | Vennett | 204/195 C |

*Primary Examiner*—R. L. Andrews
*Assistant Examiner*—Terryence Chapman
*Attorney, Agent, or Firm*—Lowe, King, Price & Becker

[57] ABSTRACT

Apparatus for use in determining electric potentials underwater includes Luggin tubes of small diameter which are open to the water at outer ends thereof. The outer ends are arranged at known spaced positions relative to one another. The potentials at the ends of the tubes are connected selectively via fluid in the tubes to a reference electrode. The potential at the reference electrode relative to a further electrode is measured.

20 Claims, 16 Drawing Figures

Fig. 6.
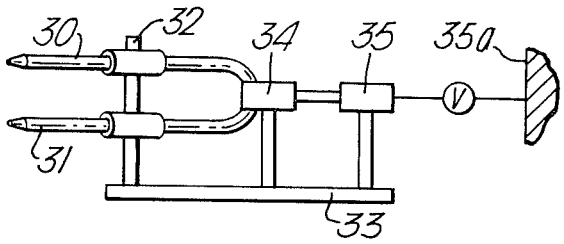
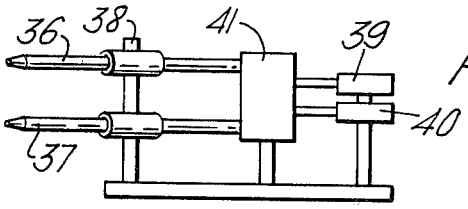
Fig. 7.
Fig. 8.
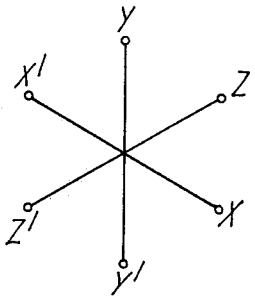
Fig. 12.
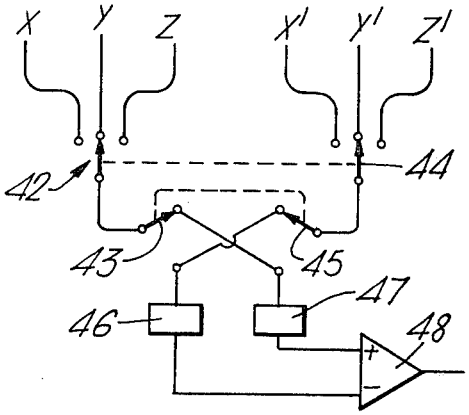
Fig. 9.
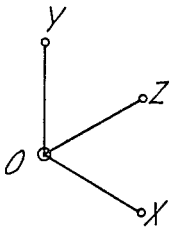
Fig. 13.
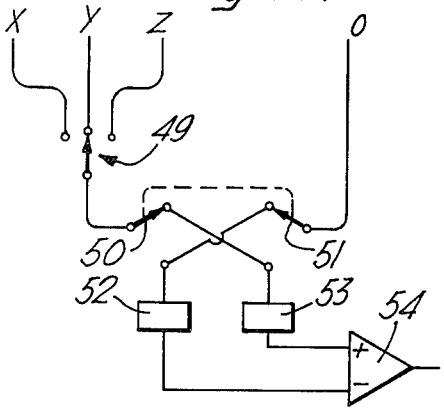

APPARATUS FOR DETERMINING UNDERWATER POTENTIAL DIFFERENCES EMPLOYING LUGGINS TUBULUS

This invention relates to apparatus and methods for use in measuring electrical potential differences and for determining current distributions and current vectors associated with such potential differences. It has particular but not exclusive reference to determining electrical potential differences in seawater adjacent steel structures.

It is well known that steel structures utilised in seawater have a tendency to corrode. If a long life is required from steel structures it is essential that they be protected in some way. The steel structures may be covered with a paint to restrict corrosion or alternatively they may be provided with a cathodic protection system. A particularly suitable form of cathodic protection system is the so-called impressed current system in which a series of permanent anodes is distributed over and adjacent the structure to be protected and the anodes are electrically connected to the structure via a current generator. The steel structure is thereby made cathodic and is thus protected. In any cathodic protection system there is a need, particularly where the system and the structure is of complex shape, to determine whether the structure is in fact being adequately protected by the cathodic protection system.

Corrosion is not a perfectly understood science, but there are a number of practically determined rules which, if complied with, lead to an adequately protected structure. Steel, when immersed in seawater, tends to corrode at particular points on the surface and the corrosion is accompanied by the transference of minute currents from the particular corrosion site to the regions around the site. It has been shown that this mean corrosion current is relatively predictable for a given structure in a given seawater at a given temperature. Corrosion problems are enhanced in cold water where there is a great deal of dissolved oxygen and such circumstances are to be found in the northern sector of the North Sea.

The practically observed rule referred to above is that if the natural corrosion currents are swamped by an applied current having a value sufficiently greater than the natural corrosion current the structure will be adquately protected.

It can be seen from this that, knowing the level of the natural or mean corrosion current, if the current density adjacent the steel structure can be measured, then the effectiveness or otherwise of an impressed current system can be adequately determined.

In practice, the way in which current densities in seawater are measured is to measure potential differences between two or more points and to calculate the current density knowing the resistance of seawater in the conditions measured. Unfortunately, the levels of the mean corrosion current and the levels of the impressed current which have to be measured are in the region of a few micro amps/cm. It is, therefore, essential, that the apparatus used to measure current densities be capable of detecting potential differences which give rise to a current density of a few micro amps/cm.

Current densities fall off only relatively slowly when measured at increasing distances from the structure, thus any errors of measurement of current densities are less critical as to distance, and err on the side of safety.

By contrast, however, potential differences are more significantly affected by distance from the structure and the potential difference measurement should be made as close to the structure as possible.

It is found that weeds and barnacles make measuring difficult close to the surface, and this can mean that potential differences are subject to error and can overstate the potential close to the surface, i.e. err on the side of danger, giving a false impression of the adequacy of the protection.

The existing methods used to determine current densities are to measure potential differences at two spaced points using half cell or reference electrodes positioned at fixed distances from one another so that from the measured potentials the current densities can be determined.

Until recently it was thought sufficient to measure the voltage adjacent a structure as a criterion of the adequacy of the cathodic protection achieved and consequently no serious attempts were made to measure current densities as such. However, increasing thought is being given to the protection of steel structures and, as a result, attempts have been made recently to determine the actual current densities. The level of voltages which can be measured—it has not at the moment proved practicable to measure currents directly—means that the natural drift in a reference electrode or standing potential differences between two reference electrodes has to be compensated for in some way.

A reference electrode or half cell may simply be regarded as a means of making an electrical connection with the electrolyte. It is used to connect the electrolyte at a given position with a voltmeter, and essentially a reference electrode draws no current and hence does not tend to interfere with the system being measured. Reference electrodes are extremely stable in that the drift on a reference electrode would be less than 0.001 v over a reasonable period of time. However, reference electrodes are susceptible to changes in temperature and even stability at the millivolt level is not sufficient when the voltages being measured are microvoltages. A system has, therefore, been developed in which two reference electrodes sample the potentials at two spaced positions, the reference electrodes being rotated so that they sample the electrolyte at a first and a second position alternately. Electrical connections are made via slip rings to a voltmeter, the output of which is a sine wave whose magnitude indicates the potential difference between the two points.

In a preferred form of the present invention there is provided apparatus for use in measuring an electric potential at or a potential difference between each of two spaced underwater positions, the apparatus including two probe tubes, each probe tube having an outer open end and an inner end, the inner end of each probe tube being connected to a fluid coupling valve for selective coupling to a reference electrode or half cell, a further electrode and means to determine the difference between the potential at the outer open end of a tube as it appears at the reference electrode or half cell and the potential at the further electrode.

The further electrode may also be a reference electrode.

Each reference or measuring electrode may be connected to three probe tubes. There may be two reference electrodes, each having three tubes. The probe ends of the six tubes may be disposed on the X, Y and Z axes with the opposing ends of the tubes on each of the X, Y and Z axes being respectively adapted to be connected simultaneously to the pair of reference electrodes.

The reference electrode or electrodes may additionally be used to determine the potential relative to a steel structure immersed in seawater provided that a suitable electrical connection can be made between the structure and the measuring circuit.

The present invention also provides a method of determining current densities in water, including the steps of:

1. determining potential differences at two or more spaced positions utilising apparatus of the type set out above;
2. establishing the resistance of the water; and
3. calculating the current density from the potential difference and the resistivity figures.

The resistance of the water can be measured by passing a known current through the water which traverses the two spaced positions or checked from known tables.

In the event that potential differences are measured in three mutually perpendicular planes, ie in the direction of the X, Y and Z axes, then a current vector can be determined by calculation.

Preferably the analogue output of the reference cells is converted to a digital output and the calculations are performed in a digital computer. The method may be used to determine current vectors adjacent the steel structure of an oil rig or platform. The data generated by the apparatus may be processed in real time or may be processed on a batch processing basis.

BRIEF DESCRIPTION OF THE DRAWINGS

By way of example embodiments of the present invention will now be described with reference to the accompanying drawings, of which:

FIGS. 6 and 7 are schematic views of apparatus for use in conjunction with the present invention;

FIGS. 8 to 11 are diagrammatic three-dimensional views of layouts for the reference electrode tubes;

FIGS. 12 to 15 are diagrammatic views of connection arrangements for the layouts illustrated in FIGS. 9 to 11 respectively.

DETAILED DESCRIPTION OF THE DRAWINGS

Figure 1:
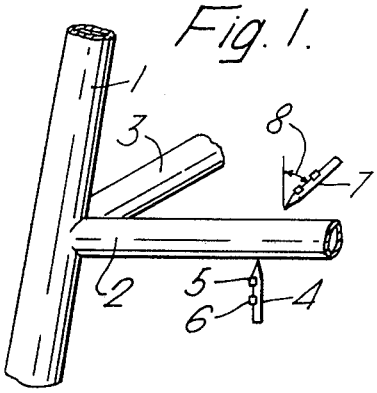
FIG. 1 is a schematic view of a portion of a steel structure.

In FIG. 1 is illustrated a steel structure 1 in the form of a leg having cross braces 2, 3 which go to make up a steel structure such as an oil rig or oil platform adapted to be immersed in sea water. The steel structure is protected from sea water corrosion by an impressed current cathodic protection system in which anodes are disposed around the structure in a known manner. The anodes are not shown in FIG. 1. In order that the potential differences around the structure can be measured a probe 4 is located adjacent the brace 2. Located on the probe 4 are a pair of reference cell electrodes 5 and 6. As the probe 4 contacts the surface of brace 2 the reference electrodes are located at a given distance from the structure and hence potential differences can be measured at a given location opposite the structure. From these potential differences it is possible to calculate current densities within the seawater adjacent the structure. Unfortunately, however, it is sometimes difficult to ensure that the probe is located perpendicular to the surface of the brace 2. Thus in the case of probe 7, which is shown approaching brace 2, the probe is not perpendicular but is located at an angle 8 to the surface. Thus the current density which would be measured would be incorrect and without knowing the exact angle 8 incorrect measurements would be made. There is a further problem in that the reference electrodes are not completely stable at the level of voltage being measured within the seawater. In order to overcome the instability problem apparatus of the type illustrated in FIG. 2 has been proposed. This apparatus basically comprises a pair of reference electrodes 9, 10 which are rotated in the direction of arrow 11. The electrical signals obtained from the reference electrodes pass via wires 12, 13 through a pressure tight seal on box 14 and are led into leads 15, 16 by means of slip rings indicated at 17, 18. Unfortunately, however, there are problems with the sealing of such an arrangement and the use of slip rings can give rise to random noise in the output of the unit, which can lead to incorrect voltages being displayed on the output of the unit. It will be appreciated that by rotating the electrodes 9 and 10 each electrode produces firstly a positive and then a negative signal and the sums of the signals are added by the apparatus. Thus any errors in either of the reference electrodes should cancel out and the sign wave output is a true difference between the values of the electrodes at first one position and then at the other.

Figure 2:
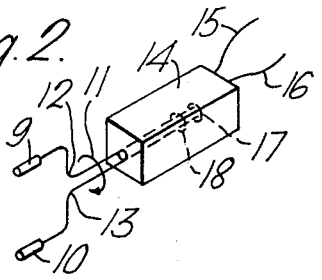
FIG. 2 is a schematic view of a rotating reference cell electrode arrangement.

Unfortunately, however, the apparatus illustrated in FIG. 2 can still produce an angle error if it is located adjacent a structure at an angle which is not perpendicular to the surface of the structure.

Figure 3:
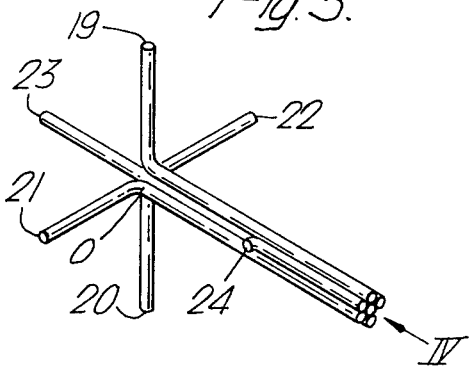
FIG. 3 is a perspective view of a probe arrangement for use in connection with the present invention.
Figure 4:
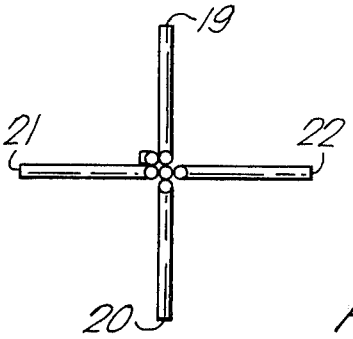
FIG. 4 is a view of FIG. 3 along the line IV.
Figure 5:
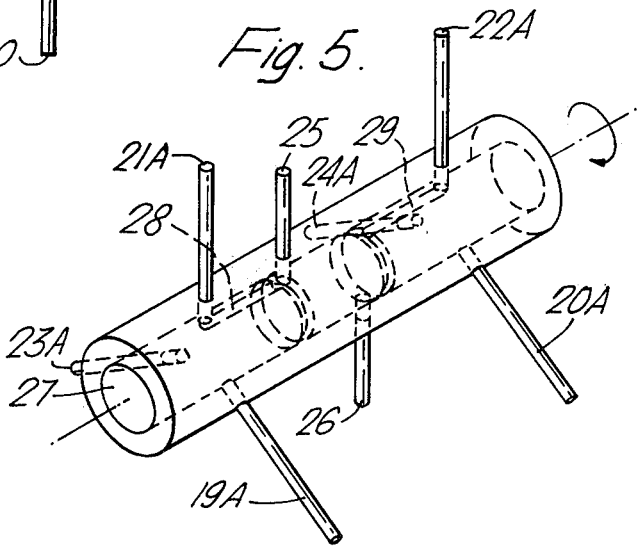
FIG. 5 is a schematic view of a valve for utilisation in accordance with the present invention.

Referring to FIGS. 3 and 4, there are shown six capillary probe tubes, known as Luggin tubes, for incorporation in one embodiment, the outer ends 19, 20, 21, 22, 23 and 24 of each probe tube being open ended, respectively. The tubes are so shaped that the outer end of each probe tube is at one end of three mutually perpendicular X, Y and Z axes and at a common distance from an origin O. The inner end of each probe tube is connected to a fluid coupling valve which is shown in FIG. 5. The valve shown in FIG. 5 has six tubular stems 19A–24A extending from the body of the valve for connection to the inner end of a respective probe tube. The outer end 19 of one probe tube is connected in use to the stem 19A, the outer end 20 is connected via the respective tube to the stem 20A, the outer end 21 is connected via the respective tube to the stem 21A and so on. Two further tubular stems 25 and 26 extend from the body of the valve and within the valve there is a rotatable core 27 which incorporates two channels 28, 29 which are able to provide separate fluid connections through the core 27. The core 27 can be rotated in such a way that the stems 25 and 26 are connected in use via the channels 28 and 29 respectively to the stems 21A and 22A, 19A and 20A or 23A and 24A.

By rotating the core 27 it is thus possible to connect electrically each pair of aligned probes 21 and 22; 19 and 20; or 23 and 24 at a time via fluid in the probe tubes and the channels 28 and 29 to the tubular stems 25 and 26. In use, separate fluid connections are provided from the tubular stems 25 and 26 to respective reference electrodes. The electric potentials at each pair of probe positions 19, 20; 21, 22; and 23, 24 applied to respective reference electrodes (not shown) can then easily be compared with the electric potential at a further electrode, which may be a reference electrode provided by a half cell.

By this arrangement there is no movement of reference electrodes and no need to provide slip rings to provide connection to a measuring or recording apparatus.

It will be appreciated that the probe tubes can be formed of any suitable insulating material, for example a plastics material or glass, and they should preferably have as small a diameter as possible in order to avoid interfering with current flows adjacent any steel structure. The probe tubes are filled in use with an electrolyte, which may be sea water, in order to provide an electrical connection for the potential at the end of the probe tube to the reference electrode. It will also be appreciated that a reference electrode draws virtually no current whereby the resistance of the electrolyte in the tube is of little significance. Thus fortuitously the different resistances of electrolyte within the different lengths of the tubes which form the probes is of little significance.

The reference electrodes used may be of any suitable type, for example a calomel electrode or a silver/silver chloride electrode.

A relatively simple form of apparatus in accordance with the invention is illustrated diagrammatically in FIG. 6. In FIG. 6 is illustrated a pair of Luggin tubes 30,31 which are fixed relative one to the other and mounted on a post 32 located on a board 33. A fluid valve 34 alternatively connects tube 30 and tube 31 with a reference reference electrode 35. The reference electrode 35 is connected via a voltmeter V to the surface of a steel structure 35*a*. The operation of the apparatus is such that rotation of valve 34 alternately connects fluid in the tubes 30 and 31 to the reference electrode 35 and permits a potential difference between points at the outer open ends of the tubes 30 and 31 to be detected. Thus without the need for electrical slip rings or other complicated electrical apparatus the potential difference between the ends of the tubes 30 and 31 relative to the steel structure can easily be measured. If required, each one of two probe tubes can be connected electrically alternately to one of two reference electrodes 39 and 40 by means of the apparatus to be described with reference to FIG. 7. In FIG. 7, there are shown probe tubes 36 and 37 supported by a support 38 and arranged for connection to reference electrodes 39 and 40 via a valve 41. Rotation of the valve 41 permits each one of the reference electrodes 39 and 40 to be connected on an alternating basis to each one of the probe tubes 36 and 37 in turn. Thus the potential difference between the ends of the probe tubes 36 and 37 can readily be monitored.

The apparatus illustrated in FIG. 7 can be used directly to calculate the current density between the ends of probe tubes 36 and 37 in a similar manner to the method described with reference to the apparatus illustrated in FIG. 2. Knowing the potential difference between the ends of the tubes and knowing the resistance of seawater the current density can readily be calculated.

As satisfactory as such an arrangement is, it does not, however, take account of incorrect geometry, should the probe tubes be positioned at an angle to the structure in the way described with reference to probe 7 in FIG. 1. The apparatus illustrated in FIGS. 3 to 5 permits not only the calculation of current densities between the opposed ends of the tubes but, because the current densities are measured sequentially in three planes, it permits the current vector to be calculated. Thus if an orientation signal is derived in synchronism with rotation of valve rotation mechanism, it is possible to produce a signal indicative of the magnitude of the current density adjacent a steel structure and an indication of the orientation and polarity of current flow through the sea water—i.e. the direction of flow of the current towards or away from the structure.

It will be appreciated that there are many arrangements of the probe tubes and reference electrodes which utilise the invention. In FIG. 8 there is illustrated diagrammatically and in perspective an arrangement in which the outer ends of six probe tubes are positioned at points X, X', Y, Y', Z, Z', corresponding to the arrangement illustrated in FIGS. 3 and 4. Illustrated in FIG. 12 are the connections which could be used to measure a current vector with the arrangement or probes illustrated in FIG. 8. Essentially the ends X, Y and Z of the tubes are connected by a rotary valve 42 to a two position valve 43. Similarly the ends X', Y' and Z' of the tubes are connected by a rotary valve 44 to a further two position valve 45. Valves 42 and 44 are ganged as are valves 43 and 45. Reference electrodes 46 and 47 are connected to the valves 43 and 45 and the electrical output of the reference electrodes is fed to a comparator circuit 48. It will be appreciated that by moving valves 42 and 44 the potentials at X, X', Y, Y' and Z, Z' at the ends of the probe tubes may be scanned sequentially and connected to the valves 43 and 45. By moving the valves 43 and 45 the potentials at any one of the positions X, Y, and Z, X', Y' and Z' can be connected to either one of reference electrodes 46 and 47.

In the embodiment illustrated schematically in FIGS. 9 and 13 there are shown three tubes, each being connected respectively to one of positions X, Y and Z, and a fourth tube which has its outer end at position O. The inner ends of the three tubes are scanned by a valve 49 and the potentials at the ends X, Y and Z are fed consecutively to a two position valve 50. The tube having its outer end at position O is connected at its inner end to a valve 51. The tubes are connected to either one of the reference electrodes 52 and 53 according to the positions of the ganged valves 50,51. The output from the reference electrodes 52,53 are fed to a comparator unit 54.

Figure 10:
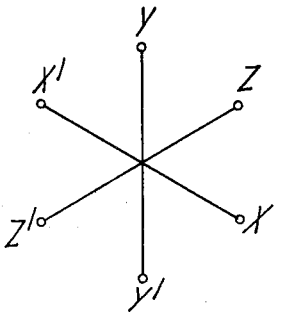
Figure 14:
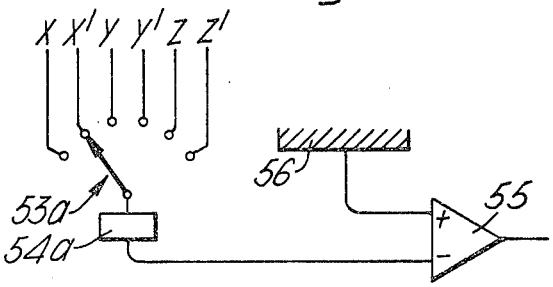

In another embodiment illustrated diagrammatically in FIGS. 10 and 14 there are six probe tubes having their outer ends at positions X, X', Y, Y', Z, Z', as illustrated in FIG. 10, and connected at their inner ends via a rotary valve 53*a* to a reference electrode 54*a*. The output from a reference electrode 54*a* is fed to a comparator 55 where it is compared to the potential of a housing 56, by which the probe tubes are supported. The arrangement illustrated in FIG. 14 enables only one reference electrode to be used, but it is less sensitive than that illustrated in FIG. 12.

Figure 11:
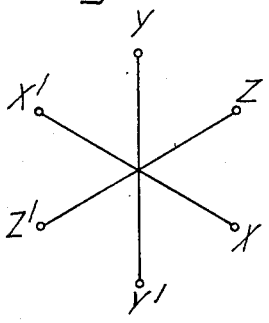
Figure 15:
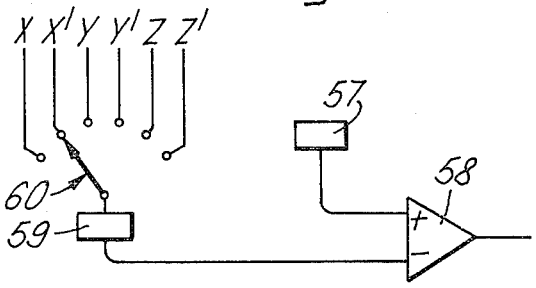

In FIGS. 11 and 15 there is illustrated an embodiment which is similar to that illustrated in FIGS. 10 and 14, except that a reference electrode 57 is used in place of the housing 56, and the comparator unit 58 compares the difference between the potentials at the reference electrode 57 and the potentials of the positions X, X', Y, Y', and Z, Z' as indicated by the reference electrode 59 which sequentially samples the positions via a rotary valve 60.

Figure 16:
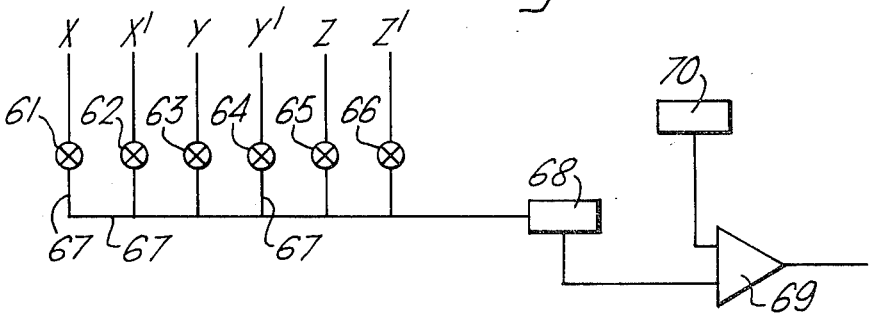
FIG. 16 is a diagrammatic illustration of a further connection arrangement.

In yet a further embodiment, illustrated in FIG. 16, there are shown diagrammatically six probe tubes having outer ends at X, X', Y, Y', Z and Z' and the inner ends of the six probe tubes are coupled electrically via a respective individual valve 61–66, a branched feed tube 67 and a reference electrode 68 to one input of a comparator 69. A reference electrode 70 is coupled to a second input of the comparator 69. The valves 61–66 are operated individually either to make or to interrupt the electrical connection between the outer end of a respective probe tube and the reference electrode 68, so that the potentials at the outer end of each probe tube can be determined selectively.

The valves or switches 61–66 are used as an alternative to the rotary valve described above.

It will be appreciated that, although the invention has been described, by way of example, with reference to particular embodiments, it is possible for variations, modifications and combinations thereof to be made within the scope of the claims.

I claim:

1. Apparatus for use in measuring an electric potential at or a potential difference between each of two spaced underwater positions, the apparatus including two probe tubes, each probe tube having an outer open end and an inner end which is capable of being electrically coupled to the outer end by fluid means within the tube, fluid coupling valve means, a reference electrode or half cell, the inner end of each probe tube being connected to the fluid coupling valve means for selective coupling of electric current at said outer end via fluid means to the reference electrode or half cell, a further electrode, and means to determine the difference between the potential at the outer open end of a tube as it appears at the reference electrode or half cell and the potential at the further electrode.

2. Apparatus as claimed in claim 1 including a rotatable member constituting a part of the fluid coupling valve means, and a fluid channel defined by the rotatable member, the member being rotatable to a first position to connect a first one of the probe tubes via the fluid channel to the reference electrode or half cell and to a second position to connect a second one of the probe tubes via the fluid channel to the reference electrode or half cell.

3. Apparatus as claimed in claim 2 including a second fluid channel defined by the rotatable member, and a second reference electrode or half cell, the said member being rotatable to connect each of the first and second probe tubes to each of the first and second reference electrodes or half cells alternately.

4. Apparatus as claimed in claim 1 including a plurality of individual coupling valves, each individual coupling valve being arranged between the inner end of a respective probe tube and a reference electrode or half cell, and each individual coupling valve being operable to couple its respective tube selectively to the reference electrode or half cell.

5. Apparatus as claimed in claim 1 including a second reference electrode or half cell constituting the further electrode.

6. Apparatus as claimed in claim 1 including a comparator for determining the potential difference, one input of the comparator being connected to the first reference electrode or half cell and another input of the comparator being connected to the further electrode.

7. Apparatus for enabling electric potential differences to be determined at spaced points on and adjacent a metal structure located in seawater and protected from corrosion by a cathodic protection system, the apparatus comprising reference electrode means, an array of dielectric probe tubes fixedly mounted relative to the structure, each probe tube in the array having an opening only at one of the spaced points so that there is a different probe tube opening at each spaced point, fluid conduit means connected in fluid flow relation to the probe tubes for providing fluid flow paths for the seawater at the openings to the reference cell means so that the electric potentials at the openings of the probe tubes are coupled by the seawater in the probe tubes and the conduit means to the reference cell means, and means responsive to the electric potential at the reference cell means for deriving an indication of the potential at one of the tube openings relative to another potential.

8. The apparatus of claim 7 further including a housing for supporting the probe tubes, means for deriving a voltage indicative of the potential of the housing, the indicating means being simultaneously connected to the voltage deriving means and the reference cell means to derive an indication of the difference between the potential at the openings and the housing.

9. The apparatus of claim 7 wherein the reference cell means includes first and second reference cells, the conduit means including means for providing separate fluid flow paths from the probe tube openings to the first reference cell, the second reference cell being mounted to provide a voltage indicative of the potential at a reference position, the indicating means being simultaneously connected to the first and second reference cells to derive an indication of the difference between the potential at the openings and the reference position.

10. The apparatus of claim 7 wherein the reference cell means includes first and second reference cells, the conduit means including means for providing separate fluid flow paths from the probe tube openings to at least one of the reference cells, the means for indicating being simultaneously connected to the first and second reference cells to be responsive to the difference in voltage at the first and second reference cells.

11. The apparatus of claim 10 wherein the conduit means includes means for providing first and second fluid flow paths from the first and second of the probe tube openings to the first and second reference cells, respectively.

12. The apparatus of claim 11 wherein the conduit means includes means for selectively changing the fluid flow paths so the fluid flow paths from the first and second of the probe tube openings are changed to the second and first reference cells, respectively.

13. The apparatus of claim 11 wherein the probe tubes are arranged so the openings thereof are arranged at mutually perpendicular points relative to an origin of a Cartesian coordinate system, and the conduit means includes means for selectively coupling fluid from different ones of the openings to one of the reference cells at a time.

14. The apparatus of claim 13 wherein the probe tubes are arranged so that there are first and second openings along each coordinate axis of the coordinate system on opposite sides of the origin, and the conduit means includes means for simultaneously coupling fluid from the first and second openings to the first and second reference cells.

15. The apparatus of claim 14 wherein the coordinate system is three dimensional and six of said probe tubes are provided.

16. The apparatus of claim 13 wherein the probe tubes are arranged so there is a first opening along each coordinate axis of the coordinate system and a second opening at the origin, and the conduit means includes means for simultaneously coupling fluid from the first and second openings to the first and second reference cells.

17. The apparatus of claim 15 wherein the coordinate system is three dimensional and three of said probe tubes are provided.

18. The apparatus of claim 11 wherein the probe tubes are arranged so the openings thereof are arranged at mutually perpendicular points relative to an origin of a Cartesian coordinate system, and the conduit means includes means for selectively coupling fluid from different ones of the openings to the first reference cell at a time.

19. The apparatus of claim 18 wherein the probe tubes are arranged so there are first and second openings along each coordinate axis of the coordinate system on opposite sides of the origin, and the conduit means includes means for simultaneously coupling fluid from the first and second openings to the first and second reference cells.

20. The apparatus of claim 19 wherein the coordinate system is three dimensional and six of said probe tubes are provided.

* * * * *